United States Patent [19]

Scholl

[11] Patent Number: 4,662,294

[45] Date of Patent: May 5, 1987

[54] DEVICE AT A SEWING MACHINE FOR APPLYING A TENSILE STRESS IN A MATERIAL TO BE FED IN A SEWING PROCESS

[75] Inventor: Hans Scholl, Oerlinghausen-Lipperreihe, Fed. Rep. of Germany

[73] Assignee: Kochs Adler AG, Bielefeld, Fed. Rep. of Germany

[21] Appl. No.: 884,479

[22] Filed: Jul. 11, 1986

[30] Foreign Application Priority Data

Aug. 16, 1985 [DE] Fed. Rep. of Germany ..... 3529329

[51] Int. Cl.[4] ..... D05B 47/04

[52] U.S. Cl. ..... 112/305; 112/255

[58] Field of Search ..... 112/255, 254, 305, 303, 112/121.26, 121.27, 2

[56] References Cited

U.S. PATENT DOCUMENTS

| | | | |
|---|---|---|---|
| 3,476,063 | 11/1969 | Bulqatz | 112/255 |
| 3,565,027 | 2/1971 | Miller et al. | 112/255 |
| 3,877,405 | 4/1975 | Dorosz et al. | 112/255 |
| 4,102,280 | 7/1978 | Hannemann | 112/121.26 |
| 4,300,465 | 11/1981 | Tsuboi | 112/255 |
| 4,449,463 | 5/1984 | Gilbride et al. | 112/121.26 |

FOREIGN PATENT DOCUMENTS

| | | | |
|---|---|---|---|
| 2157016 | 11/1971 | Fed. Rep. of Germany | 112/254 |
| 1106672 | 3/1968 | United Kingdom | 112/255 |

*Primary Examiner*—H. Hampton Hunter
*Attorney, Agent, or Firm*—Max Fogiel

[57] ABSTRACT

A device at a sewing machine for applying a tensile stress in a material to be fed for sewing, particularly a thread, a ribbon etc. Several pneumatic cylinders are arranged in parallel for generating a variable force acting upon at least one friction element. Several pneumatic cylinders are combined into groups, which are selectively controllable by compressed air valves and a selector switch. Due to the special construction of the pneumatic cylinders, there is obtained a cost-saving tensioning device for generating a tensile stress in a material.

6 Claims, 13 Drawing Figures

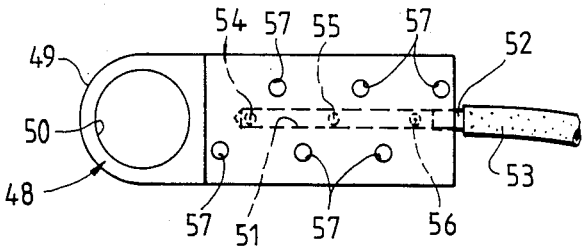
Fig. 4
Fig. 10
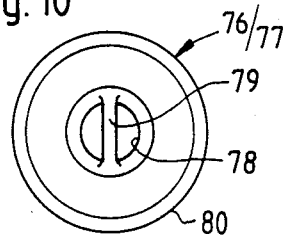
Fig. 5
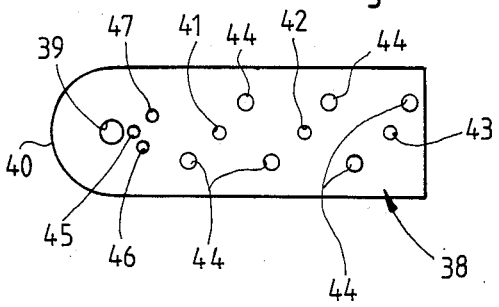
Fig. 6
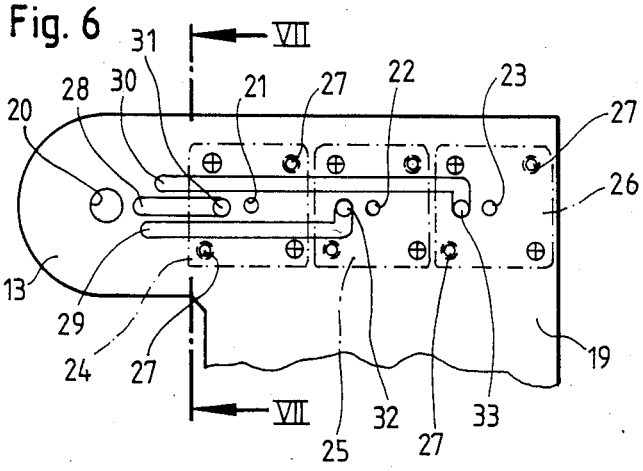
Fig. 7
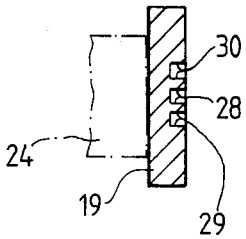
Fig. 8
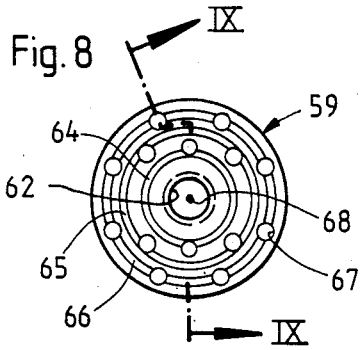
Fig. 9
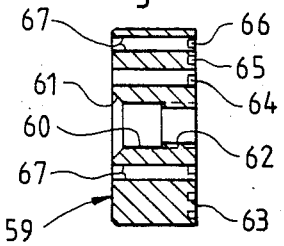

DEVICE AT A SEWING MACHINE FOR APPLYING A TENSILE STRESS IN A MATERIAL TO BE FED IN A SEWING PROCESS

BACKGROUND OF THE INVENTION

The present invention relates to a device at a sewing machine for applying a tensile stress in a material to be fed in a sewing process. In particular, the device is provided with several pneumatic cylinders arranged in parallel and including a control with control valves for digitally controlling the pneumatic cylinders in order to generate a variable force acting upon at least one friction element.

From U.S. Pat. No. 3,877,405 a device for tensioning the thread to be fed for sewing is known. This known device is provided with air pressurizable cylinders, which are actuated by the control depending on certain sewing parameters in order to vary the generated tensile stress in the thread. The known device, however, renders possible to vary only the tensile stress by a few values. Moreover, considerable space is required, which reduces the clearance under the sewing machine arm.

From the German Offenlegungsschrift No. 2,157,016 it is known to provide elements at a thread tensioning device which make possible a reproducable fine adjustment. This tensioning device has a limited range of adjustment and does not make possible quick repetitive finding of which is required with frequent changes of materials to be stressed.

SUMMARY OF THE INVENTION

It is a main object of the present invention to provide a device of the above-described type, which makes it possible to efficiently enlarge the range of adjustment, and which makes possible a time-saving repetitive finding, with operating reliability, of an adjustment that was previously found by experience to be correct.

A further object of the present invention is to provide a device of the aforesaid type, which provides a fine adjustment over the total adjustment range of equally distributed values of tensile stress.

Still a further object of the present invention is to provide a device of the aforementioned type, which can be manufactured at low costs and which is constructed compactly and is reliable in operation.

Other objects, advantages and features of the present invention will appear from the detailed description of the preferred and modified embodiments, which will now be explained in conjunction with the accompanying drawings.

BRIEF DESCRIPTION OF THE DRAWINGS

FIG. 4 is a view of an element of the device according to arrow IV in FIG. 3, on a reduced scale;

FIG. 5 is a view of a further element of the device according to arrow IV in FIG. 3, on a reduced scale;

FIG. 6 is a view of a still further element of the device in the direction of arrow IV in FIG. 3, FIG. 7 is a sectional view through the element illustrated in FIG. 6 taken along section VII—VII;

FIG. 8 is a front view of a further element of the device, according to arrow VIII in FIG. 3;

FIG. 9 is a sectional view of the element illustrated in FIG. 8, taken along section IX—IX;

FIG. 10 is a front view of a further element of the device according to the present invention in the direction of arrow VIII in FIG. 3;

DESCRIPTION OF THE PREFERRED EMBODIMENTS

Figure 1:
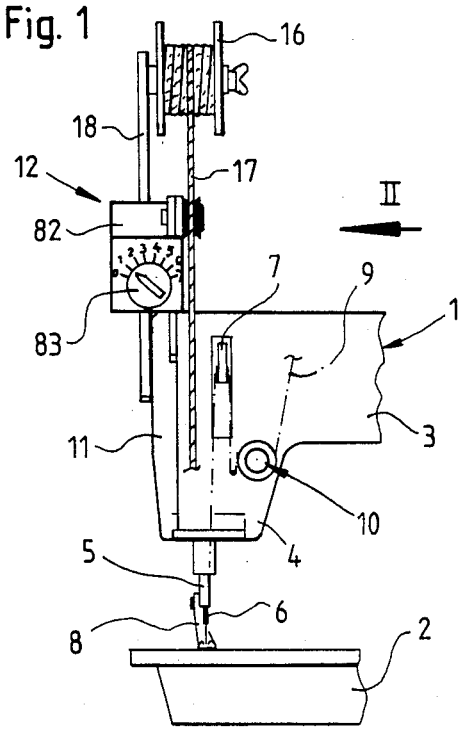
FIG. 1 is a front view of a part of a sewing machine, at the head of which is arranged a device according to the preferred embodiment of the present invention.
Figure 2:
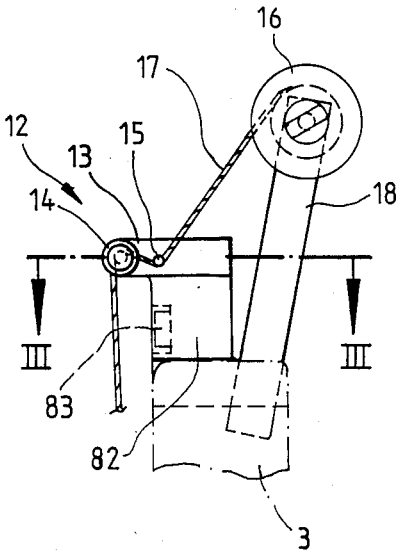
FIG. 2 is a side elevation of the device according to the arrow II in FIG. 1.

A sewing machine 1 is formed in the usual manner with a base plate 2, to which is connected an arm 3 terminating in a head 4. In the head 4 there is reciprocatingly supported a needle bar 5 carrying at its lower end a needle 6. The needle bar 6 is drivingly connected to a crank drive provided in the head 4 and serving as the drive of a thread take-up lever 7. Moreover, in the head 4 there is displaceably received presser foot bar (not illustrated) extending in parallel with the needle bar 5. The lower end of the presser foot bar is provided with a presser foot 8 surrounding the needle 6. To perform the sewing process, a thread 9 is led from a thread supply (not illustrated) to a thread tensioner 10, which is arranged in the area of the head 4. After passing the thread tensioner 10, the thread 9 extends, via the thread take-up lever 7, to the needle 6 and then into the workpiece to be sewn. According to FIG. 1 the head 4 of the sewing machine 1 is closed by a cover 11.

In a preferred embodiment, in the area of the cover 11 there is secured a tensioning device 12 to the arm 3 of the sewing machine 1. The tensioning device 12 is formed with an arm 13 provided with a tensioning place 14. Moreover, the tensioning device 12 is provided with a guide 15, through which is guided, to the tensioning place 14, a ribbon 17, that is supplied from a spool 16. The spool 16 is rotatably supported on a carrier arm 18, which is fastened to the cover 11 of the sewing machine 1. The ribbon 17 is led from the tensioning place 14 to the stitch forming area in order to be sewn.

The arm 13 is a part of a plate 19, which hereinafter is described in conjunction with FIGS. 6 and 7. The arm 13 of the plate 19 extends semi-circularly about a bore 20. Furthermore, the plate 19 is formed with three through-holes 21, 22, 23 each serving for supplying electrically actuable valves 24, 25, 26 with compressed air. The valves 24, 25, 26 are each screwed by means of two screws (each marked in FIG. 6 symbolically by a circle with a cross therein). For this reason, the plate 19 is provided with correspondingly threaded bores. According to FIG. 6, the plate 19 is formed with further six threaded through-bores 27.

Figure 3:
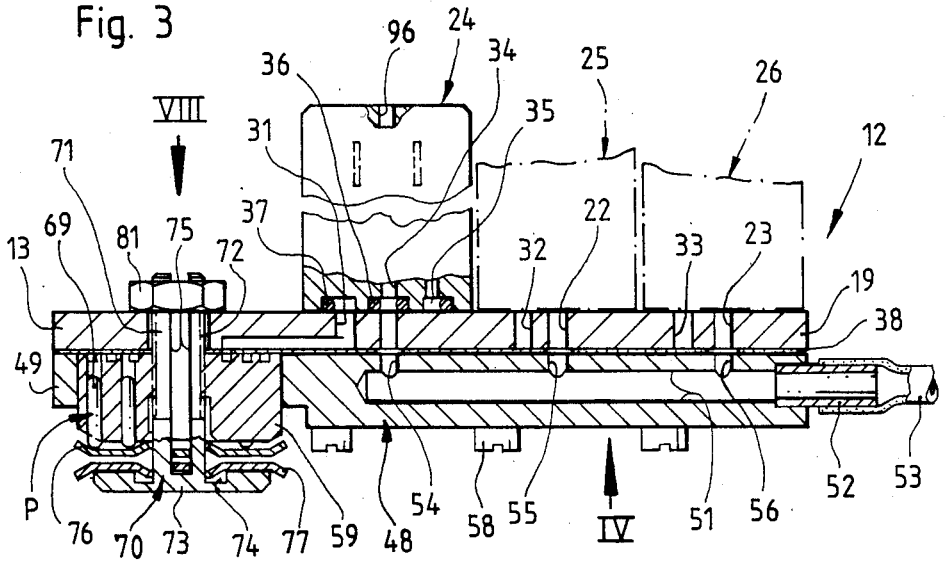
FIG. 3 is a semi-sectional view through the device according to the present invention, taken along section III—III in FIG. 2, on an enlarged scale.

As also evident from FIG. 7, in the side of the plate 19 turned away from the screwing side of valves 24, 25, 26 there are located a short, an intermediate, and a long canal 28, 29, 30, which enter the plates 19 by half of its total thickness. The canals 28, 29, 30 are dimensioned as they terminate at different distances with respect to the bore 20. The free ends of the canals 28, 29, 30 discharge in bores 31, 32, 33 carried through the plate 19. FIG. 3 is a sectional view of the flange-connection of the valve 24 with the plate 19. As evident, the valve 24 is supplied with compressed air via a bore 34, which, depending on the switch condition of valve 24, is shut off or led into an annular canal 35. From here the compressed air is guided through the bore 31. In order to assure a tight connection between the valves 24, 25, 26 and the plate 19, O-rings, 36, 37 are provided in corresponding recesses (not illustrated) of the individual valves.

In FIG. 5 there is illustrated a gasket 38, which is punched out of an approx. 0,5–1 mm thick, oil resistant sealing material. Also, the gasket 38 is provided with a bore 39, the diameter of which corresponds to that of the bore 20. The gasket 38 is formed with a semi-circular circumferential area 40, having a shape which is equal to the semi-circular arm 13 of the plate 19. The gasket is formed with further three bores 41, 42, 43, which coincide with the positions of the through-holes 21, 22, 23 of the plate 19. Moreover, the gasket 38 is provided with six opening 44 having positions corresponding to those of the threaded through bores 27 of the plate 19. In the area of the bore 39 of the gasket 38 there are located further recesses 45, 46, 47, having positions corresponding to those of the ends of the canals 28, 29, 30 turned to the bore 20 of the plate 19.

In conjunction with FIGS. 3 and 4, there is described a supply part 48 of the tensioning device 12 according to the present invention. The supply part 48 is provided with a semi-circular end 49, which is formed with a through-hole 50. The end 49 is reduced with respect to the thickness of the supply part 48. Moreover, in the supply part 48 there are formed a sack bore 51 having a free end provided with a tube 52 for receiving a hose 53, and three recesses 54, 55, 56, which run out in the sack bore 51. The recesses 54, 55, 56 are positioned so that they are flush with the through holes 21, 22, 23 of the plate 19 when in an installed condition according to FIG. 3. Finally, the supply part 48 is still penetrated by six bores 57 having positions corresponding to those of the threaded through bores 27 of the plate 19 when in an installed condition according to FIG. 3. As further evident from FIG. 3, the supply part 48 is firmly connected to the plate 19 by six screws 58 and the gasket located therebetween.

In FIGS. 8 and 9 there is illustrated a cylindrical housing 59, in which a bore 60 is formed coaxially and has a bevel-formed recess 61 and a thread 62. The thread 62 runs out at a front surface 63 of the housing 59. In the front surface 63 there are formed three annular canals 64, 65, 66 extending coaxially with respect to the bore 60 or the thread 62. Moreover, according to FIG. 8, the housing 59 is penetrated by a plurality of receses 67, which extend in parallel to the bore 60 or the thread 62. As further evident from FIG. 8, a number of two of the recesses 67 terminates in the inner canal 64, a number of four of the recesses 67 terminates in the intermediate canal 65, and a number of eight of the recesses 67 in the outer canal 66. Thus, the numbers of recesses 67 form a proportion of 2:4:8=1:2:4. The arrangement of the recesses 67 in the housing 59 is selected, so that they do not mutually disturb and so that their center of gravity of a surface each is located in a center 68 of the cylindrical housing 59.

Figure 11:
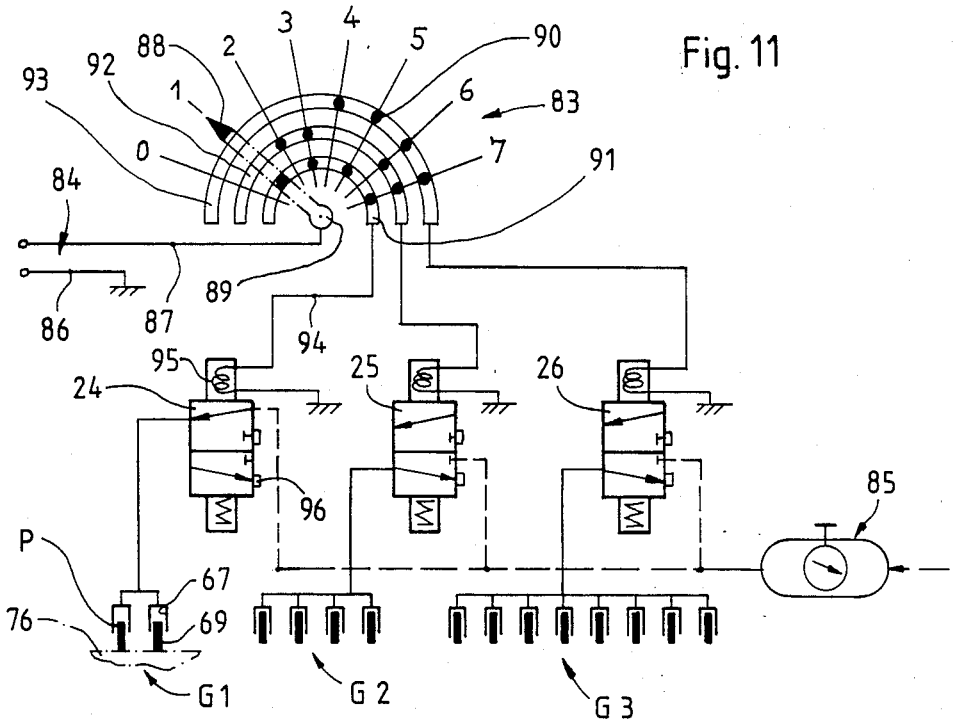
FIG. 11 is a diagrammatic illustration of a control for controlling the device according to the present invention.

According to FIG. 3, in each recess 67 there is received axially displaceable, with a given amount of play a pin 69, thus forming a pneumatic cylinder P. According to the numbers of recesses 67, the individual numbers of pneumatic cylinders P are in the proportion 1:2:4. The two pneumatic cylinders P connected to the inner canal 64 are combined to a group G1, the four pneumatic cylinders P are connected to the intermediate canal 65 to a group G2, and the pneumatic cylinders P are connected to the outer canal 66 to a group G3 (FIG. 11). In the thread 62 of the housing 59 there is received a bearing bolt 70, which is provided with a shank 71 formed with a corresponding outer thread 72. The shank 71 terminates in a head 73 formed at the transition area with respect to the shank 71 with a recess 74. Furthermore, the bearing bolt 70 is formed over the total length of the shank 71 with a slot 75, which is diametrically arranged with respect to the cylindrical cross-section of the shank 71.

According to FIG. 3 two identically-formed tensioning discs 76, 77 are received by the shank 71. The construction of the tensioning discs 76, 77 is obvious from FIGS. 3 and 10. The tensioning discs 76, 77 are essentially circularly formed and are provided with a bore 78. Through the bore 78 extends a stem 79. The stem 79 and the bore 78 are dimensioned so that the tensioning discs 76, 77 may be received with play on the shank 71 of the bearing bolt 70. In view of the fact that the stem 79 penetrates the slot 75 of the shank 71, the tensioning discs 76, 77 are secured against torsion with respect to the bearing bolt 70. Between the tensioning discs 76, 77 there is guided the ribbon 17, which contacts the shank 71. To prevent the ribbon 17 from becoming damaged, the tensioning discs 76, 77 are conically profiled at their outer margin 80 and at the circumferential area limiting the bore 78. Tensioning discs of such construction are known in the prior art from thread tensioners used in sewing machines.

As evident from FIG. 3, the bearing bolt 70 together with the tensioning discs 76, 77 received thereon, and the screwed on housing 59 including the pins 69 arranged therein, is screwed together with the aforementioned screwed elements (supply part 48, gasket 38 and plate 19) by a nut 81.

As evident from FIG. 1, the tensioning device 12 is accommodated in a box-shaped housing 82. Furthermore, in the housing 82 there are accommodated an eight-position-selector switch 83 with wiring to the valves 24, 25, 26 (still to be described) and a current-supplying cable 84.

Operation of the tensioning device 12 is described as follows:

The construction and cooperation of the individual components make possible that the different groups G1, G2, G3 of the pneumatic cylinders P may be controlled individually or in combination by the different valves 24, 25, 26. In view of the aforedescribed construction of the housing 59, resultant forces of the individual groups G1, G2, G3 of the pneumatic cylinders P are formed. These act in the center 68 and thereby centrally upon the circular tensioning disc 76.

This embodiment including the three individual groups G1, G2, G3 of pneumatic cylinders P results in $2^3=8$ switching possibilities. As the valves 24, 25, 26 each are connected to the sack bore 51, each valve 24, 25, 26 is supplied with the same compressed air pressure, which is adjustable at a controller 85, with the aforedescribed construction by the valves 24, 25, 26 a sensitive, eight-place adjustment of the tensioning device 12 is achieved.

FIG. 11 is a diagrammatic illustration of a switch position, in which the selector switch 83 is set to the switch position 1 as shown also in FIG. 1. While a wire 86 of the cable 84 is connected to ground, another wire 87 is connected to a sliding contact 88 of the selector switch 83. The sliding contact 88 is rotatably supported at center 89 and forms an electrical connection to one or several contact points 90, which are arranged on an inner, intermediate, and outer circular conducting path 91, 92, 93. Accordingly, in switch position 1 current is supplied to the inner conducting path 91, which is connected via a cable 94 to a solenoid 95 of the valve 24, illustrated schematically in FIG. 11. The free end of the solenoid 95 in turn is connected to ground. As evident from the schematic illustration of the valves 24, 25, 26 in FIG. 11, the valves 24, 25, 26 are provided with a pressure release 96 formed as a bore at the free end of each valve body. The switch combination resulting from the switch position 1 of the selector switch 83 makes possible that the valve 2 is actuated while the valves 25, 26 are inoperative. Finally, in this switch position the inner cancel 64 is supplied with compressed air due to the construction and the cooperation of the individual elements. Thus, also the group G1 associated with the inner canal 64 is supplied with compressed air and actuated by means of two pins 69. Finally, the actuated pins 69 come into contact with the tensioning disc 76, while the groups G2 and G3 are not actuated via solenoids 96 of the valves 25 and 26. The tensioning disc 76 comes into contact with the passed-through ribbon 17 and presses it against the tensioning disc 77, which is supported at the head 73.

Resetting of the selector switch 83 to another position makes possible that a more or less large resultant force acts upon the ribbon 17, so that, due to the generated friction at the tensioning discs 76, 77, an adjustable amount of tensile stress may be imparted to the ribbon 17. Thus, according to FIG. 11, in the switch position O none of the valves 24, 25, 26 is actuated, so that the tensioning discs 76, 77 are not actuated by the pneumatic cylinders P, and the ribbon 17 may pass the tensioning device 12 without tensile stress. In view of the fact that the shank 71 is connected to the housing 59 via the threads 62, 72, it is possible to adjust the distance between the two tensioning discs 76, 77 which may exist when the valves 24, 25, 26 are inoperative. Thus, it is possible to adjust the tensioning device 12 according to the different thicknesses of ribbons or other materials.

Figure 13:
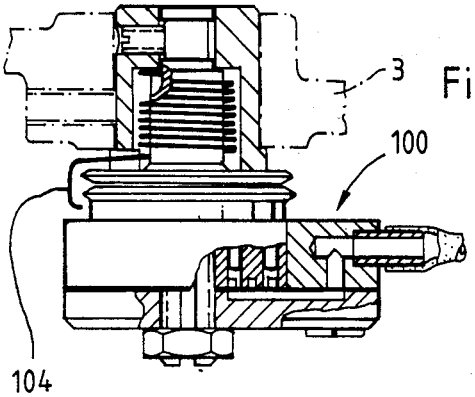
FIG. 13 is a partially sectional top plan view of the device according to arrow XIII in FIG. 2.
Figure 12:
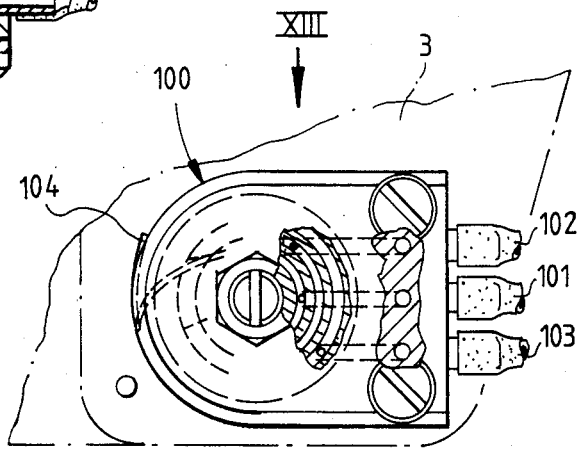
FIG. 12 is a view of an area of the sewing machine illustrated in FIG. 1, in which there is arranged the device according to the modified embodiment of the present invention.

In a modified embodiment corresponding to FIGS. 12 and 13, there is illustrated another arrangement of a tensioning device, which is denoted hereinafter by 100. This tensioning device 100 is arranged at the arm 3 of the sewing machine 1, instead of the thread tensioner 10. Contrary to the foregoing embodiment, the individual valves 24, 25, 26 are not here integrated but are arranged at another place in the area of the sewing machine 1. In this case the valves are supplied with compressed air via three separate hoses 101, 102, 103. Moreover, as evident from FIGS. 12 and 13, the tensioning device 100 is additionally formed with a check spring 104, which is also commonly known from thread tensioners used in sewing machines. The operation of the tensioning device 100 corresponds to that of the tensioning device 12 as already explained. However, it is conceivable to control the individual valves not manually via a selector switch but via an electronic control, which would make it possible to change the tensile stress to be applied to a sewing thread, dependent on different sewing parameters even during the sewing process.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What we claim is:

1. A device at a sewing machine for applying a tensile stress in a material to be fed for sewing, particularly a thread or a ribbon, comprising: a plurality of pneumatic cylinders arranged in parallel for generating a variable force; at least one friction element actuated by said force; and control means having control valves for digitally controlling said pneumatic cylinders; said pneumatic cylinders being combined in groups each having a different number of said pneumatic cylinders.

2. A device according to claim 1, wherein the dimensions and numbers of said pneumatic cylinders are such selected so that a series of equally distributed values of said tensile stress can be generated.

3. A device according to claim 1, wherein said pneumatic cylinders are provided with uniformly dimensioned pistons, and said different numbers of said pneumatic cylinders are in the proportion 1:2:4.

4. A device according to claim 3, wherein said friction element comprises a circular disc, said groups of said pneumatic cylinders being formed so that their resultant forces act centrally upon said circular disc.

5. A device according to claim 4, wherein said groups of said pneumatic cylinders are each arranged on concentrical paths with respect to said resultant forces; and concentric canals for supplying said different groups with compressed air.

6. A device according to claim 1, wherein said pistons comprise cylindrical pins.

* * * * *